US007567767B2

(12) United States Patent
Kikuchi

(10) Patent No.: US 7,567,767 B2
(45) Date of Patent: Jul. 28, 2009

(54) IMAGE FORMING APPARATUS AND IMAGE FORMING PROCESS CONTROLLING METHOD

(75) Inventor: Kazuhiko Kikuchi, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 244 days.

(21) Appl. No.: 11/764,868

(22) Filed: Jun. 19, 2007

(65) Prior Publication Data

US 2008/0013970 A1 Jan. 17, 2008

(30) Foreign Application Priority Data

Jun. 30, 2006 (JP) ..... 2006-182129
Jun. 30, 2006 (JP) ..... 2006-182130

(51) Int. Cl.
*G03G 15/00* (2006.01)

(52) U.S. Cl. ..... 399/82; 399/87

(58) Field of Classification Search ..... 399/24, 399/27, 75, 82, 85, 87, 120, 252, 255, 258
See application file for complete search history.

(56) References Cited

U.S. PATENT DOCUMENTS 5,394,231 A * 2/1995 Sudo et al. ..... 399/228
6,519,424 B2 2/2003 Matsuura et al.
7,203,436 B2 * 4/2007 Imamiya ..... 399/53
7,499,655 B2 * 3/2009 Yamauchi et al. ..... 399/24

FOREIGN PATENT DOCUMENTS

| | | | |
|---|---|---|---|
| JP | 06-324600 | | 11/1994 |
| JP | 8-30147 | * | 2/1996 |
| JP | 09-146418 | | 6/1997 |
| JP | 10-171198 | | 6/1998 |

* cited by examiner

*Primary Examiner*—Hoan H Tran
(74) *Attorney, Agent, or Firm*—Turocy & Watson, LLP

(57) ABSTRACT

An image forming apparatus to form an image on a sheet by permanent color toner and decolorizing toner to be decolorized includes a detector unit to detect whether a predetermined identification image to indicate execution of a image forming process by decolorizing toner is formed or not at least on either of a first side and a second side of a sheet which is a subject of the image forming process to be executed and a process controlling unit, when the predetermined identification image is detected by the detector unit, to prohibit the image forming process by permanent color toner on a sheet side on which the predetermined identification image is detected.

19 Claims, 10 Drawing Sheets

IMAGE FORMING APPARATUS AND IMAGE FORMING PROCESS CONTROLLING METHOD

CROSS-REFERENCE TO RELATED APPLICATION

This application is based upon and claims the benefit of priority from the prior Japanese Patent Applications No. 2006-182129 filed on Jun. 30, 2006 and No. 2006-182130 filed on Jun. 30, 2006, the entire contents of which are incorporated herein by reference.

BACKGROUND

1. Field of the Invention

The present invention relates to an image forming apparatus and an image forming process controlling method to form an image on a sheet by permanent color toner and decolorizing toner to be decolorized.

2. Description of the Related Art

In Japanese Patent Application Publication No. 11-212338, the image forming art applied to an image forming apparatus of an intermediate transfer system is disclosed. In the image forming apparatus, by a rotary developing device, on a photosensitive drum, four colors of yellow (Y), magenta (M), cyan (C), and black (K) are developed one by one, thus a toner image is formed. The toner image obtained by forming the colors on the photosensitive drum one by one like this is transferred onto an intermediate transfer belt at a primary transfer position.

Thereafter, the photosensitive drum and intermediate transfer belt timely make 4 revolutions, thus a toner transfer image of full color of 4 superimposed colors is formed on the intermediate transfer belt and the toner transfer image is secondarily transferred onto a transfer sheet which is a recording medium by a secondary transfer unit. The transfer sheet on which the superimposed toner image is transferred secondarily is fixed by a fixing unit and then is externally taken out.

Conventionally, as a product using decolorizing toner, an image forming apparatus using a constitution that a black developing unit of a monochromatic printer or a monochromatic MFP is replaced with decolorizing toner is commercialized. However, it is an exclusive device, so that when copying a use not suited to use decolorizing toner (printing a document requiring long-term preservation, etc.), another printer or MFP capable of printing by permanent color toner must be used.

A sheet which is subject to the decolorizing process after forming an image by decolorizing toner is hardly distinguished from a new sheet at a glance. When forming an image on such a sheet regenerated after the decolorizing process by permanent color toner like this, the concerned sheet cannot be reused by the image forming process by decolorizing toner.

SUMMARY

An aspect of the present invention, when reusing a sheet on which an image is formed using decolorizing toner, provides an image forming apparatus for disturbing image formation by permanent color toner.

According to an aspect of the present invention, there is provided an image forming apparatus to form an image on a sheet by permanent color toner and decolorizing toner to be decolorized, comprising a detector unit to detect whether a predetermined identification image for indicating execution of an image forming process by decolorizing toner is formed or not at least on either of a first side and a second side of a sheet which is a subject of the image forming process to be executed; and a process controlling unit to prohibit the image forming process by the permanent color toner on the sheet side on which the predetermined identification image is detected when the identification image is detected by the detector unit.

Furthermore, according to an aspect of the present invention, there is provided an image forming apparatus to form an image on a sheet by permanent color toner and decolorizing toner to be decolorized, comprising a mode discriminate unit, regarding an image forming process to be executed, to discriminate which is selected, a first mode to perform an image forming process by permanent color toner or a second mode to perform the image forming process by decolorizing toner; and an identification image forming unit, when it is discriminated by the mode discrimination unit that the second mode is selected, in the image forming process in which it is discriminated that the second mode is selected, to form a predetermined identification image to indicate execution of the image forming process by decolorizing toner on a sheet on which an image is to be formed by decolorizing toner.

Furthermore, according to an aspect of the present invention, there is provided an image forming process controlling method for an image forming apparatus to form an image on a sheet by permanent color toner and decolorizing toner to be decolorized, comprising detecting whether a predetermined identification image to indicate execution of an image forming process by decolorizing toner is formed or not at least on either of a first side and a second side of a sheet which is a subject of the image forming process to be executed; and prohibiting, when the predetermined identification image is detected, the image forming process by the permanent color toner on the sheet side on which the predetermined identification image is detected.

Furthermore, according to an aspect of the present invention, there is provided an image forming process controlling method for an image forming apparatus to form an image on a sheet by permanent color toner and decolorizing toner to be decolorized, comprising discriminating, regarding an image forming process to be executed, which is selected, a first mode to perform the image forming process by permanent color toner or a second mode to perform the image forming process by decolorizing toner; and forming, when it is discriminated that the second mode is selected, in the image forming process in which it is discriminated that the second mode is selected, a predetermined identification image to indicate execution of the image forming process by the decolorizing toner on a sheet on which an image is to be formed by the decolorizing toner.

DETAILED DESCRIPTION OF THE EMBODIMENTS

Hereinafter, the embodiment of the present invention will be explained in detail with reference to the accompanying drawings.

Figure 1:
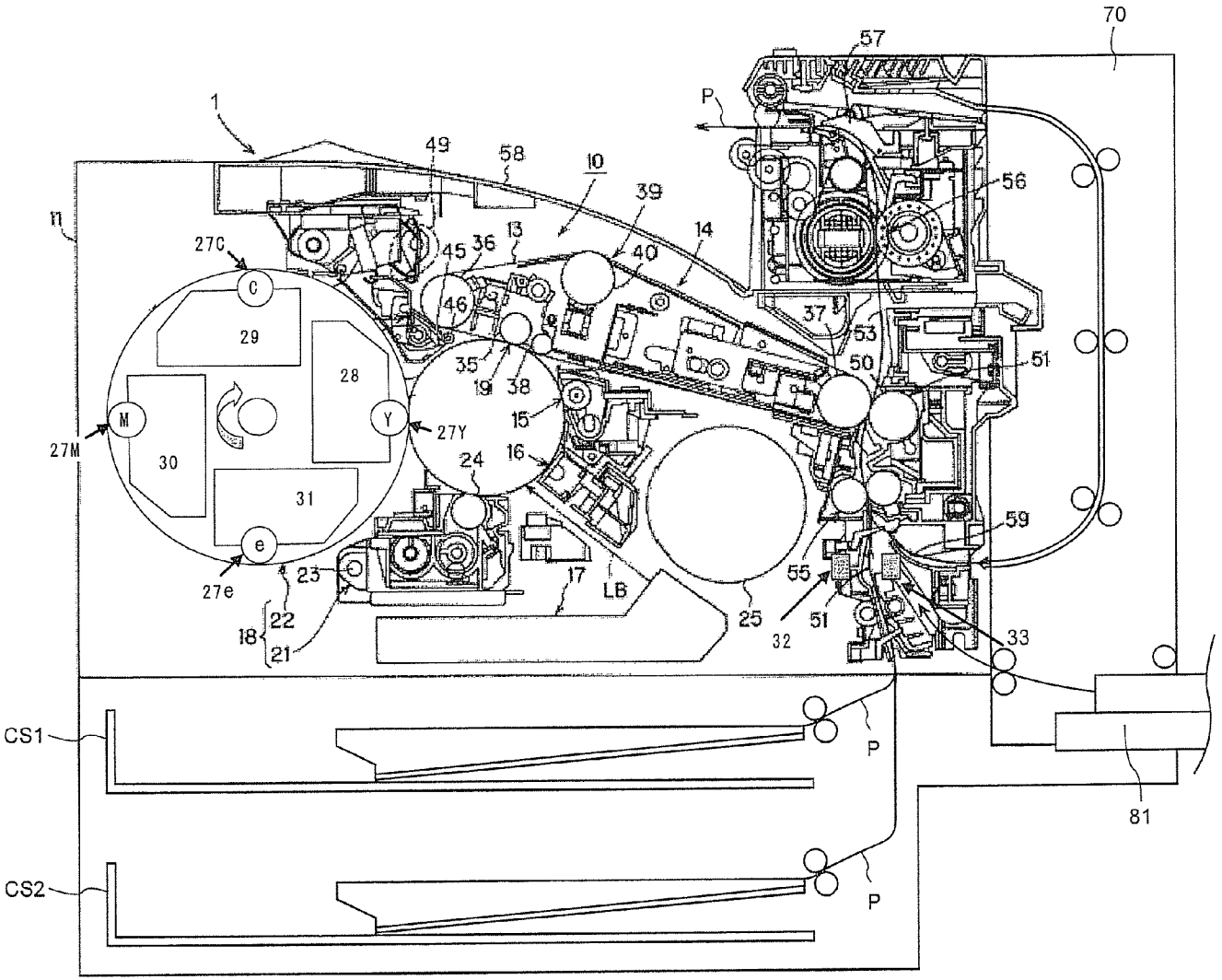
FIG. 1 is a schematic cross sectional view showing the image forming apparatus relating to an embodiment of the present invention.

As shown in FIG. 1, the image forming apparatus relating to an embodiment of the present invention is applied to an electro-photographic digital copier, an intermediate transfer MFP (multifunction peripheral), and others.

In an image forming apparatus 1, an image forming portion 10 is stored in a printer unit of a main body 11. The image forming portion 10 has a photosensitive drum (an image carrying member) 12 supported rotatably and an intermediate transfer unit 14 having an intermediate transfer belt.

On the outer periphery of the photosensitive drum 12, a cleaning device 15, a main charger 16, an optical laser unit 17, a developing device 18, and a primary transfer unit 19 are arranged sequentially. The drum cleaning device 15 removes toner remaining on the drum surface. The main charger 16 charges uniformly the drum surface at a predetermined potential. The optical laser unit 17 irradiates a laser beam LB to the drum surface uniformly charged according to image information and forms an electrostatic latent image. The developing device 18 develops the drum surface on which an electrostatic latent image is formed and forms a toner image of a predetermined color. The primary transfer unit 19 transfers primarily the toner image formed on the drum surface to the intermediate transfer belt 13.

The developing device 18 is composed of a developing device 21 (fixed developing unit) for holding a developing unit 24 of black (K) toner (black permanent color toner) and a rotary developing device (rotary developing unit) 22 for rotatably holding color toner and decolorizing toner.

The developing device 21 holds either of the first developing unit and second developing unit at a predetermined position in the neighborhood of the second developing position (the touching position of the photosensitive drum 12 and a magnet roller 27K shown in FIG. 1) for the photosensitive drum 12 so as to touch and separate freely from the second developing position of the photosensitive drum 12.

The developing device 21 of black toner has the magnet roller 27K which rotates round a rotary fulcrum 23 and can touch and separate freely from the drum surface. To the developing device 21 of black toner, black toner is fed from a black toner bottle 25 via a toner feed path not drawn. The use amount of black toner is larger than that of color toner, so that the developing device 21 of black toner is independent of the developing device 22 of color toner. Further, the decolorizing toner in this case is assumed as, for example, black. When the color of decolorizing toner is made similar to that of black toner like this, which is to use to perform the image forming process, black permanent color toner or decolorizing toner can be selected optionally regardless of the color tone of an image.

Further, when making the color of decolorizing toner similar to that of black toner, with respect to the shape of the toner containers removable from the developing units, it is desirable to form the toner container of either of the developing unit 24 and developing unit 31 so as to be unmountable in the other one of the developing unit 24 and developing unit 31. By doing this, the toner container of decolorizing toner and the toner container of black toner can be prevented from mounting by mistake.

Figure 2:
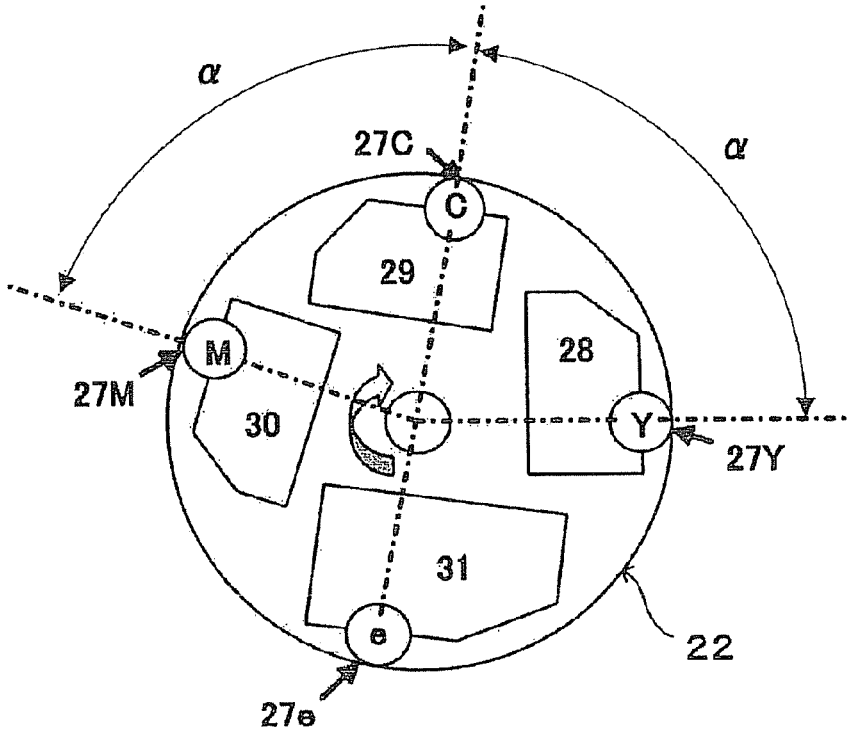
FIG. 2 is a schematic view showing the rotary developing device.

FIG. 2 is a drawing showing the rotary developing device 22 in detail and the decolorizing (e) developing unit (second developing unit) 31 has a larger developer capacity than those of the other yellow (Y), magenta (M), and cyan (C) (permanent color toners other than black which are different in color) developing units 28, 29, and 30 (third developing units), and between (Y) and (C) and between (C) and (M), the developing units are arranged respectively at a central angle of $\partial°$, and the central angle $\partial$ is 90°, preferably 80° or smaller. The developing units 28 to 31 of different color toners have magnet rollers 27Y, 27M, 27C and 27*e* which can selectively make contact with the surface of the photosensitive drum 12. As mentioned above, the rotary developing device 22 rotatably holds either of the first developing unit and second developing unit and the third developing unit and by this rotary movement, moves a desired developing unit to the first developing position (the touching position of the photosensitive drum 12 and magnet roller 27Y shown in FIG. 1) to the photosensitive drum 12.

The developing device 18 develops an electrostatic latent image formed on the surface of the photosensitive drum 12 with toner of a predetermined color (K, Y, M or e), and forms a toner image of the predetermined color on the drum surface.

However, when decolorizing toner is selected, the operation with the other toners is not performed and the "decolorizing toner mode" for independently performing image formation only with decolorizing toner is set. On the other hand, when performing image formation using permanent color toner, the "permanent color toner mode" is used and these modes, on the basis of image data which is a printing subject or on the basis of operation input of a user, are selected.

The toner image formed on the photosensitive drum 12, by the rotation of the photosensitive drum 12 as a rotator, is sent to the primary transfer position where the primary transfer unit 19 is installed. The toner image, onto the intermediate transfer belt 13 as one of the rotators at the primary transfer position, is transferred primarily by contact with a transfer roller 35 and charging. By the primary transfer unit 19, the toner image on the photosensitive drum 12 is transferred onto the intermediate transfer belt 13, thus a toner transfer image is formed.

On the photosensitive drum 12, the toner image forming step for making one to four revolutions according to the color of the toner image formed is repeated, and the toner image formed on the photosensitive drum 12 is superimposed on the intermediate transfer belt 13, and a toner transfer image with one to four colors superimposed is obtained (in the case of one revolution, a copy of a single color and in the case of four revolutions, a copy of four colors excluding decolorization).

The intermediate transfer belt 13 of the intermediate transfer unit 14 is wound and suspended between a drive roller 36 and a driven roller 37. The intermediate transfer belt 13 composes a rotator for reaching the driven roller 37 from the drive roller 36 via the transfer roller 35 of the primary transfer unit 19 and a wrapping roller 38 and then reaching the drive roller 36 from the driven roller 37 via a tension roller 40 composing a belt tension unit 39.

The intermediate transfer belt 13 is driven to move counterclockwise in FIG. 1. The belt tension during moving is adjusted by the tension roller 40 and the contact force of the intermediate transfer belt 13 with the photosensitive drum 12 is adjusted by the wrapping roller 38. The wrapping roller 38 winds the intermediate transfer belt 13 round the photosensitive drum 12 and adjusts so as to make the drum contact area large.

Between the drive roller 36 for driving the intermediate transfer belt 13 and the primary transfer roller 35, a belt cleaner 44 is installed. In the belt cleaner 44, a cleaning blade 45 circumscribing the intermediate transfer belt 13 is supported rotatably round a fulcrum 46. The cleaning blade 45 is pressed elastically so as to make contact with the intermediate transfer belt 13 by the spring force of a spring member 47, thereby removes toner on the intermediate transfer belt 13. Removed waste toner is conveyed to a waste toner box (not drawn) by a waste toner conveying means such as a spiral shaft.

Further, on the belt cleaner 44, a cam mechanism 49 for separating the cleaning blade 45 from the intermediate transfer belt 13 against the spring force of the spring member 47 is installed. By the cam mechanism 49, at time of toner transfer image formation, the cleaning blade 45 is separated from the intermediate transfer belt 13 and is held in the non-contact status.

Furthermore, the driven roller 37 of the intermediate transfer belt 13 composes an idler roller and composes a secondary transfer unit 51 between the idler roller and a secondary transfer roller 50 installed opposite to it. In the secondary transfer unit 51, the secondary transfer roller 50 makes contact with a transfer sheet which is a recording medium at the secondary transfer position and by contact with the secondary transfer roller 50 and charging, the toner image on the intermediate transfer belt 13 is transferred secondarily onto the transfer sheet.

The secondary transfer roller 50 of the secondary transfer unit 51 is installed so as to freely separate and touch the driven roller 37 of the intermediate transfer belt 13 and at time of secondary transfer of a toner transfer image, the secondary transfer roller 50 circumscribes the intermediate transfer belt 13. On the other hand, other than at time of secondary transfer, for example, at time of superimposition of a toner transfer image on the intermediate transfer belt 13, the secondary transfer roller 50 is separated from the intermediate transfer belt 13. By separation of the secondary transfer roller 50 from the intermediate transfer belt 13, it is intended to prevent a toner image as a primary transfer image superimposed on the intermediate transfer belt 13 from adversely affected.

At the secondary transfer position of the secondary transfer unit 51, the toner image on the intermediate transfer belt 13 is transferred secondarily onto a transfer sheet P, and the transfer sheet P is taken out from sheet cassettes CS1 and CS2 stored at the lower part of the main body 11 and is conveyed along a conveying path 53. On the conveying path 53, an aligning roller 55 for positioning transfer sheets along the conveying path 53, the secondary transfer unit 51 for transferring secondarily a toner image onto transfer sheets, a fixing device 56 for fixing the secondarily transferred toner transfer image, and a guide gate 57 are arranged sequentially. The transfer sheet P on which the secondarily transferred toner image is fixed by the fixing device 56 is ejected and accumulated on a receiving tray 58 from the conveying path 53. The receiving tray 58 is formed on the top of the main body 11.

On the other hand, transfer sheets as a recording medium can be fed not only from the sheet feed cassette but also from a manual sheet feed tray 81. Sheets fed from the manual sheet feed tray 81 are led to the conveying path 53 before the aligning roller 55 via a sheet feed guide path 59.

Further, in this embodiment shown in FIG. 1, the developing unit containing decolorizing toner is installed in the rotary developing device 22, though it may be installed at the position of the black (K) developing unit and can be mounted by a user at an appropriate position depending on the use frequency of decolorizing toner.

Figure 3:
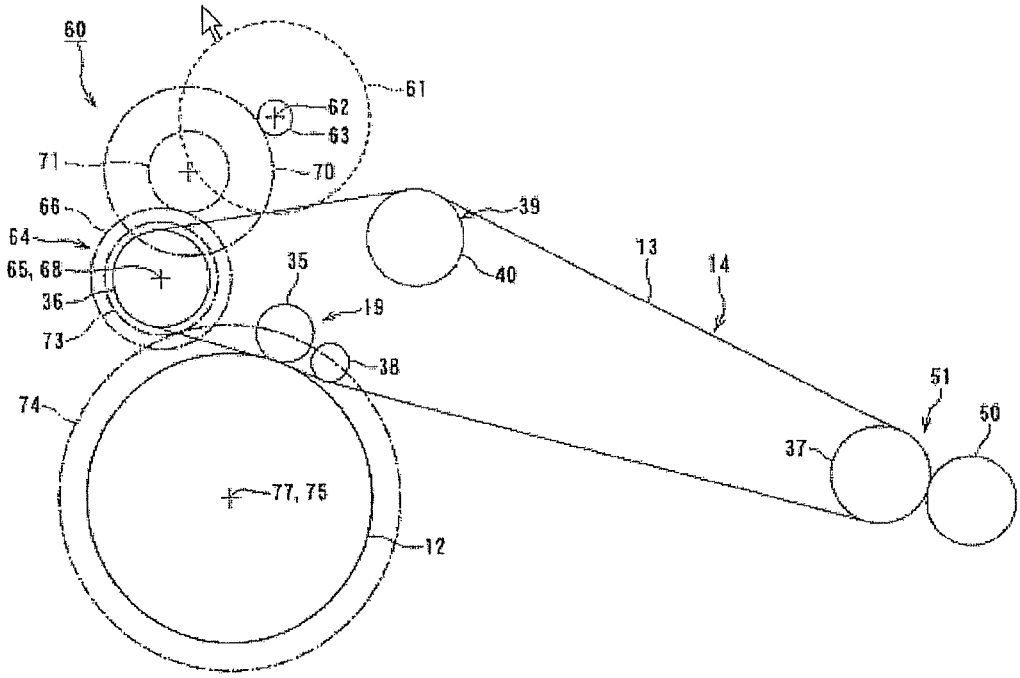
FIG. 3 is a schematic view showing the constitution of the rotary member drive unit.
Figure 4:
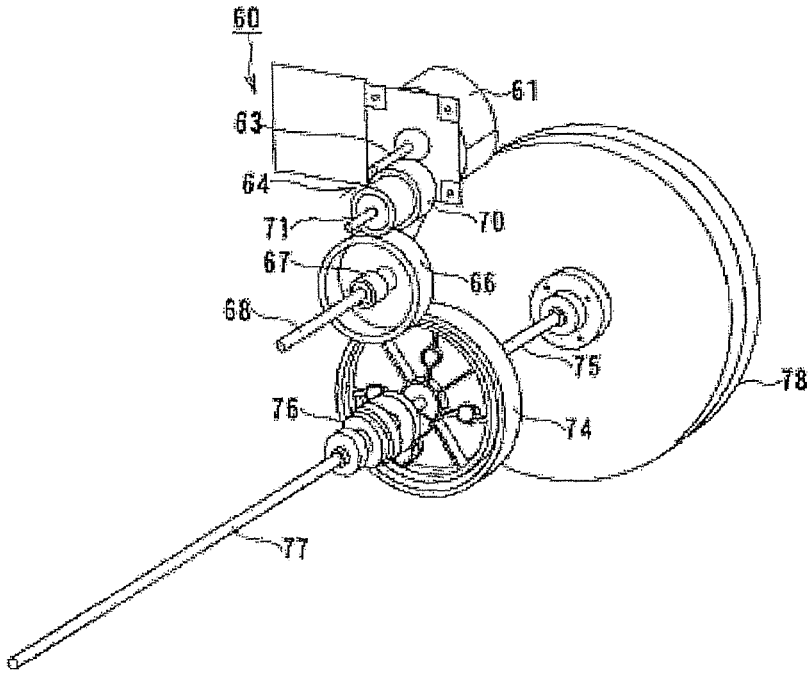
FIG. 4 is a perspective view showing the rotary member drive unit.

The photosensitive drum 12 and intermediate transfer belt 13 are driven by the rotary member drive unit 60 shown in FIGS. 3 and 4. The rotary member drive unit 60 is installed on the rear side of the image forming apparatus 1 and has a common drive motor 61 as a drive source for the photosensitive drum 12 and intermediate transfer belt 13. As a drive motor 61, a servo-motor having little rotation vibration, a stepping motor of micro-steps, or a DC brushless motor is used.

On an output shaft 62 of the drive motor 61, a motor drive gear 63 is united with it or is installed integrally with it. The motor drive gear 63 meshes with an intermediate driven gear 66 installed on a belt drive shaft 65 via a reduction gear mechanism 64 composing a reduction gear train assembled stepwise and in series and is connected with it in operation. The belt drive shaft 65, as shown in FIG. 4, is connected to a roller support shaft 68 via an intermediate driven gear 67. The roller support shaft 68 supports the drive roller 36 of the intermediate transfer belt 13 integrally with rotation.

The reduction gear mechanism 64 composes a first stage reduction gear train by a drum drive gear 74 meshing with the motor drive gear 63 and composes a second stage intermediate reduction gear train by an intermediate drive gear 71 installed integrally with the drum drive gear 74 and the intermediate driven gear 67 meshing with the drive gear 71. The intermediate driven gear 67 of the intermediate reduction gear train functions as an intermediate driven gear for driving the drive roller 36 of the intermediate transfer belt 13 to rotate.

Further, on the intermediate driven gear 66 of the intermediate reduction gear train, a last stage drive gear 73 is united with it or is installed integrally with it, and the last stage drive gear 73 directly meshes with the last stage driven gear 74, and the last stage reduction gear train is formed as a reduction gear train for driving the photosensitive drum 12. The drive gear 73 composing the last stage reduction gear train is formed integrally with the intermediate driven gear 66, while the drive gear 73 meshes directly with the driven gear 74 composing the drum driven gear 74 composing the drum drive gear. As mentioned above, the intermediate driven roller 66 meshes with the drum drive gear 74 via the drive gear 73. The driven gear 74 as a drum drive gear is axially mounted on a drum drive shaft 75. Further, in FIG. 3, each gear of the multi-stage reduction gear train composing the reduction gear mechanism 64 is indicated by a pitch circuit of a dashed-dotted line.

On the drum drive shaft 75, a drum drive coupling 76 is installed on the front side and is connected to a drum support shaft 77 via the coupling 76. On the rear side of the drum drive shaft 75, a flywheel 78 having a large inertia amount is installed integrally with rotation. The flywheel 78 is structured by forming a metallic plate such as zinc in a disk shape. On the drum support shaft 77, the photosensitive drum 12 is supported integrally with rotation and by rotation driving by the drum drive shaft 75, the photosensitive drum 12 is driven so as to rotate. The rotation driving for the photosensitive drum 12, by the inertia amount of the flywheel 78 axially attached to the drum drive shaft 75, is carried out stable and smoothly free of uneven rotation.

In the rotary member drive unit 60, the intermediate driven gear 66 for driving the intermediate transfer belt 13 and the last stage drive gear 73 are united with each other or are installed integrally with each other and are attached to the belt drive shaft 65, and the last stage drive gear 73 attached to the belt drive shaft 65 is meshed directly with the drum drive gear (last stage driven gear) 74. Moreover, the flywheel 78 is attached to the drum drive shaft 75, thus the driving of the photosensitive drum 12 can be stabilized. Furthermore, the intermediate transfer belt 13 driven on the upstream side of the driving of the photosensitive drum 12 can also be belt-driven by the inertia action of the flywheel 78, and the inertial amount of the belt driving is increased, thus the driving can be stabilized.

In the rotary member drive unit 60, the multi-stage, for example, three-stage reduction gear train is composed of one system in series, and the intermediate driven gear 66 (73) of the intermediate transfer belt 13 and the drum drive gear 74 of the photosensitive drum 12 mesh directly with each other, and the flywheel 78 is attached to the drum drive shaft 75 of the photosensitive drum 12. Therefore, both behaviors of the drum driving of the photosensitive drum 12 and the belt driving of the intermediate transfer belt 13 can be synchronized, and the flywheel effect (action of the inertia force) is permitted to act on both, thus the driving can be stabilized.

Further, the photosensitive drum 12 driven to rotate at a large deceleration ratio is driven to decelerate on the downstream side of the intermediate driven gear 66 (73) for driving the intermediate transfer belt 13. Therefore, the multi-stage reduction gear train from the drive motor 61 to the photosensitive drum 12 can be continued at a slow deceleration ratio.

Each gear of the reduction gear train composing the reduction gear mechanism 64 is a helical gear formed by resin molding such as injection molding. As a gear material, polyacetal resin excellent in dimensional stability, self lubricity, and moldability may be used. Further, synthetic resin such as polyimide or polycarbonate having little thermal expansion may be used. Furthermore, resin obtained by filling polycarbonate with glass reinforced fibers to increase strength and rigidity may be used. Further, resin obtained by blending polycarbonate with fluorine plastic to improve self lubricity may be used.

When resin-molding each gear of the reduction gear train to a helical gear, to suppress vibration due to gear meshing as little as possible, the gear module is made smaller such as 0.5 or less. The meshing width of the gears of the reduction gear train is set between 12 mm and 25 mm, preferably to about 18 mm in a real machine. By doing this, it is possible to control the gear vibration due to meshing small and lower the gear noise. In a helical gear having a gear meshing width of 25 mm or more, an accurate draft angle cannot be obtained, and gear molding is difficult, and gear manufacture is attended with difficulties, while when the gear meshing width is 12 mm or less, it is difficult to control the gear vibration small.

Figure 5:
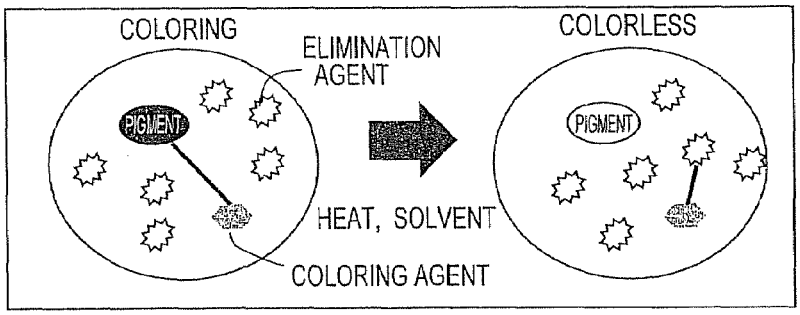
FIG. 5 is a schematic view showing the decolorizing principle of decolorizing toner.

FIG. 5 is a drawing for explaining the decolorizing principle of decolorizing toner. Into decolorizing toner, "pigment coloring agent", and also "elimination agent" are added. Pigment displays a color by bonding molecularly to a coloring agent, though when adding heat or a solvent, the bonding is cut off and the color disappears. In this case, the coloring agent separated is permitted to bond to an elimination agent to prevent recombination of the pigment and coloring agent, and the decolorized status is maintained, and a printed sheet is heated in an elimination device for heating it at a predetermined temperature or higher for several hours, thereby it returns to a white sheet.

As shown in FIG. 1, in the image forming apparatus 1 of this embodiment, in the neighborhood of the aligning roller 55 on the upstream side in the sheet conveying path, a pair of detectors 32 and 33 (second detection units) are arranged. Further, the detectors 32 and 33, for example, are arranged so as to read the neighborhood of the central position in the perpendicular direction to the conveying direction of sheets conveyed on the sheet conveying path. The detectors 32 and 33 detect the printing statuses (the sides are used or unused, or a specific mark is printed) of the sheet sides such as the image side and non-image side. For the detectors 32 and 33, for example, an optical sensor is used.

Further, in the embodiment shown in FIG. 1, the developing unit 31 containing decolorizing toner in the rotary developing device 22 can be replaced with the black (K) developing unit 24. Namely, a user highly frequently using decolorizing toner replaces the developing unit 31 containing decolorizing toner with the black (K) developing unit 24, thereby it can be adjusted by him. Here, as a method for replacing the developing unit 31 containing decolorizing toner with the black (K) developing unit 24, there is a method available, for example, for realizing by making the external forms of both developing units similar to each other. As mentioned above, it is preferable for the developing device 21 to hold a one of high frequency in use among the developing units 31 and 24.

In this embodiment, the developing unit 31 of decolorizing toner is incorporated into the rotary developing device 22 and the capacity of the toner container for storing toner by the developing unit 31 of decolorizing toner (either of the first and second developing units) is set so as to be larger than the capacities of the toner containers for storing toner by the developing units 28 to 30 (the third developing units) of color toner. As mentioned above, the developer capacity of decolorizing toner is structured so as to be larger than the developer capacity of color toner. By doing this, not only the constitution takes a user of monochromatic toner into account but also for a user generally more frequently using decolorizing toner than black toner, the black developing unit and decolorizing toner developing unit are made compatible with each other. Namely, when the decolorizing developing unit is installed at the position of the black developing unit, the copying speed when decolorizing toner is developed can be increased. By doing this, in the case of color copy, four colors are arranged in the revolver, so that the speed is maintained.

Furthermore, for a use having a high use ratio of decolorizing toner, the decolorizing toner developing unit 31 is replaced with the black developing unit 24, and the developing unit 31 is held by the developing device 21, thus decolorizing toner can be fed from a toner feed bottle with a large capacity.

Namely, an image forming apparatus for forming a color image by four revolutions of one photosensitive drum having a developing device using a constitution of YMCK+decolorizing toner is obtained. Furthermore, in an image forming apparatus having four developing units of YMC+decolorizing toner in the rotary developing device, since the consumption amount of monochromatic toner is larger than the consumption amount of color toner, the developer capacity of the black and decolorizing toner developing unit is made larger than the capacity of a color developer, thus for a user frequently using monochromatic toner, the exchange frequency of consumption articles can be made smaller.

In addition, the capacity of the toner container for storing toner by a developing unit (for example, the developing unit 24) held by the developing device 21 can be set so as to be larger than the capacity of the toner container for storing toner by a developing unit (for example, the developing unit 31) held by the developing device 22. By doing this, the toner capacity corresponding to the frequency in use of each toner by a user can be ensured and it can contribute to reduction in the maintenance cost. Further, when using a constitution that the developing unit 31 is held by the side of the developing device 21 and the developing unit 24 is held by the side of the developing device 22, it is preferable to set the capacity of the toner container of the developing unit 31 larger than the capacity of the toner container of the developing unit 24.

Figure 6:
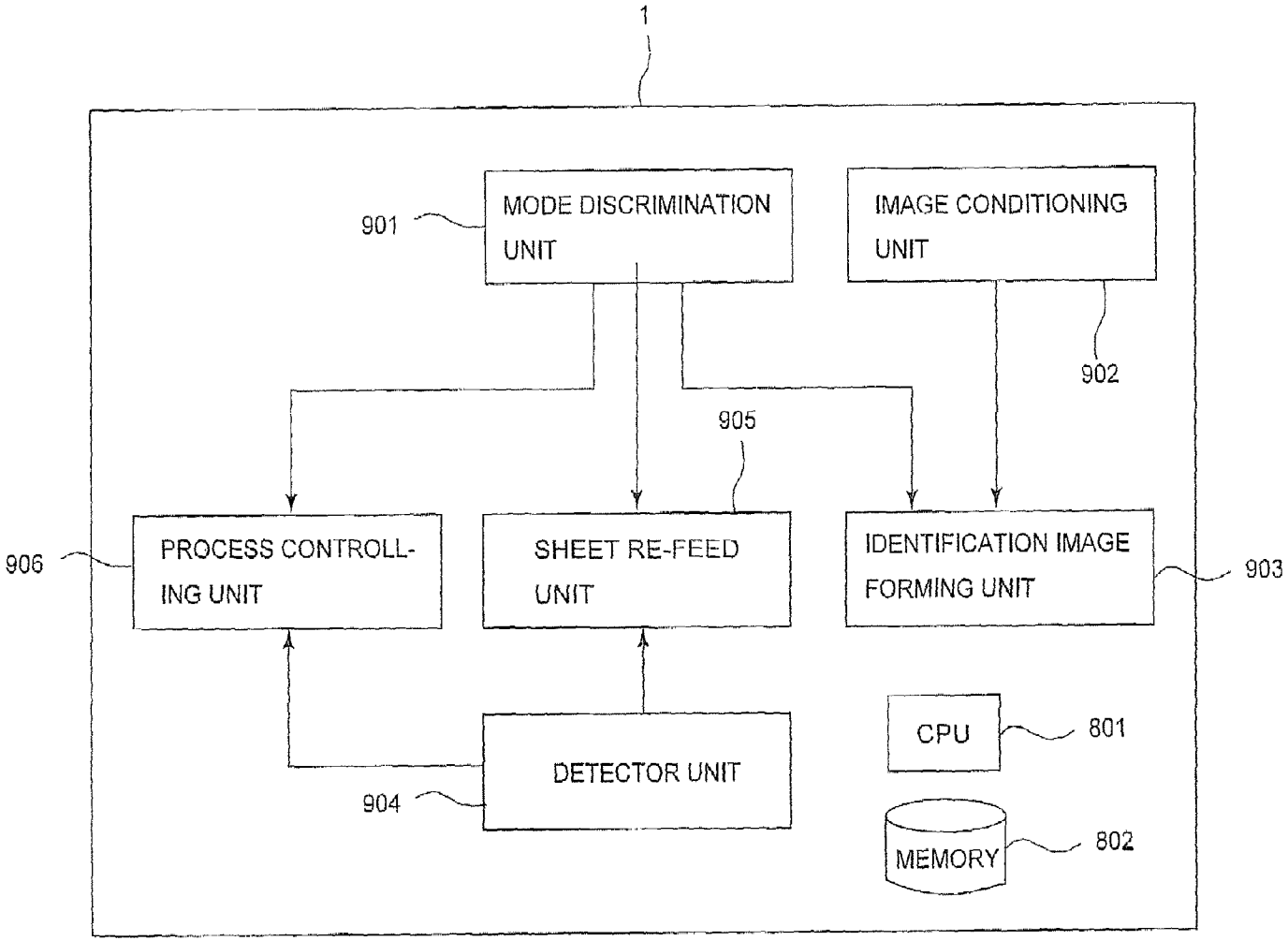
FIG. 6 is a block diagram showing the schematic constitution of the image forming apparatus relating to an embodiment of the present invention.

FIG. 6 is a function block diagram for explaining the function of the image forming apparatus of this embodiment. The image forming apparatus of this embodiment is composed of a mode discriminate unit 901, an image conditioning unit 902, an identification image forming unit 903, a detector unit 904, a sheet re-feed unit 905, a process controlling unit 906, a CPU 801, and a memory 802.

The mode discriminate unit 901, for the image forming process to be executed, discriminates which is selected, the first mode for performing the image forming process by permanent color toner or the second mode for performing the image forming process by decolorizing toner.

The image conditioning unit 902 reduces an image to be formed on a sheet to a size smaller than a predetermined area to form an image and forms it on the sheet by the image forming apparatus.

The identification image forming unit 903, when it is discriminated that the second mode is selected by the mode discriminate unit 901, in the image forming process in which the second mode is discriminated to be selected, on a sheet on which an image is formed by decolorizing toner, forms a predetermined identification image for indicating that the image forming process by decolorizing toner is performed by decolorizing toner. Further, the identification image forming unit 903 forms the predetermined identification image in the neighborhood of the central part of the sheet in the perpendicular direction to the sheet conveying direction in the image forming apparatus or in the neighborhood of the sheet end. Further, the identification image forming unit 903 can be structured so as to form an identification image outside and in a predetermined area of the image reduced by the image conditioning unit 902.

The detector unit 904, at least on either of the first side and second side of a sheet which is a subject of the image forming process to be executed, detects whether the predetermined identification image for indicating that the image forming process by decolorizing toner is executed is formed or not.

The sheet re-feed unit 905, when it is discriminated that the predetermined identification image is detected by the detector unit 904 and the first mode is selected by the mode discriminate unit 901, permits the permanent color sheet cassette CS2 which is a specific sheet feed cassette to refeed sheets.

The process controlling unit 906, when the predetermined identification image is detected by the detector unit 904, prohibits the image forming process by permanent color toner on the sheet on which the predetermined identification image is detected. Further, the process controlling unit 906, when the predetermined identification image is detected by the detector unit 904 and the second mode is selected by the mode discriminate unit 901, can permit to perform the image forming process by decolorizing toner on the sheet on which the predetermined identification image is detected. Further, the process controlling unit 906 can permit to perform the image forming process by permanent color toner on a sheet refed by the sheet re-feed unit 905.

The CPU 801 has a roll of performing various processes of the image forming apparatus and executes the program stored in the memory 802, thereby realizes various functions, The memory 802 is composed of, for example, a ROM or a RAM and stores various information and programs used by the image forming apparatus.

Next, the operation of the image forming portion 10 relating to this embodiment will be explained.

After start of driving of the image forming portion 10, on the surface of the photosensitive drum 12, a predetermined potential is impressed uniformly by the main charger 16.

The drum surface charged uniformly at the predetermined potential by the main charger 16 is irradiated with and exposed to a laser beam LB according to the image information from the optical laser unit 17, thus an electrostatic latent image is formed on the drum surface. The image information, according to a predetermined resolution, for example, 600 dpi and gradation, is sent from a host device (not drawn) such as a host computer and a personal computer which are not drawn.

On the other hand, the surface of the photosensitive drum 12 on which the electrostatic latent image is formed is then developed by the developing device 18 and a toner image of a predetermined color is formed on the drum surface.

Concretely, for example, by the black toner developing device 21, the surface of the photosensitive drum 12 is developed and a toner image is formed by black toner. During development of the surface of the photosensitive drum 12 by the black toner developing device 21, the color toner developing device 22 is kept in the separation state from the surface of the photosensitive drum 12.

The black toner image formed on the photosensitive drum 12 is transferred primarily onto the intermediate transfer belt 13 by contact with the transfer roller 35 of the primary transfer unit 19 and charging.

After the toner image formed on the surface of the photosensitive drum 12 is transferred onto the intermediate transfer belt 13, toner remaining on the surface of the photosensitive drum 12 is removed by the drum cleaning device 15.

The residual toner is removed from the photosensitive drum 12 by the drum cleaning device 15, and the cleaned photosensitive drum 12 is sent again to the main charger 16, and charging of the drum surface, beam exposure by laser irradiation, development and primary transfer of the toner image are repeated. The photosensitive drum 12, according to the number of superimposed colors of a toner transfer image formed on the intermediate transfer belt 13, makes one to four revolutions, thus the toner image development and formation step is repeated.

Toner images sequentially formed on the photosensitive drum 12 are transferred primarily onto the intermediate transfer belt 13 so as to be put into a state of mutually superimposed images by the transfer operation by the primary transfer unit 19.

The photosensitive drum 12 and intermediate transfer belt 13, as shown in FIGS. 2 and 3, by the driving force of the drive motor 61, are driven synchronously via the reduction gear train of one system in the multi-stage series state. The photosensitive drum 12 is driven to make gear reduction on the downstream side of the reduction gear train from the intermediate transfer belt 13.

At the primary transfer position, by the primary transfer unit 19, toner images of one to four colors of yellow (Y), magenta (M), cyan (C), black (K), and decolorization (e)

(decolorizing toner is excluded) are transferred sequentially on the intermediate transfer belt 13, and the toner transfer images mutually superimposed are formed on the intermediate transfer belt 13 rotating in synchronization with the photosensitive drum 12. The superimposed toner transfer images transferred primarily on the intermediate transfer belt 13 by the primary transfer unit 19 are then sent to the secondary transfer position and here, are transferred secondarily onto a transfer sheet conveyed on the conveying path 53 by contact with the transfer roller 50 of the secondary transfer unit 51 and charging.

The transfer roller 50 of the secondary transfer unit 51, during forming of the primary transfer toner image on the intermediate transfer belt 13, is kept in the state of separation from the intermediate transfer belt 13.

After the toner images are transferred secondarily onto the transfer sheet from the intermediate transfer belt 13 by contact with the transfer roller 50 of the secondary transfer unit 51 and charging, toner remaining on the intermediate transfer belt 13 is cleaned and removed by the belt cleaner 44. The intermediate transfer belt 13 with the residual toner removed is conveyed again to the primary transfer position. At the primary transfer position, the toner images on the photosensitive drum 12 are transferred primarily again onto the intermediate transfer belt 13 the intermediate transfer unit 19 and the next transfer cycle is repeated.

On the other hand, at the transfer position of the secondary transfer unit 51, by the transfer operation by contact with the transfer roller 50 and charging, the toner images on the intermediate transfer belt 13 are transferred secondarily onto a transfer sheet, and then the transfer sheet is conveyed along the conveying path 53 and is sent to the fixing device 56. In the fixing device 56, the toner images transferred secondarily are heated by a pair of heat rollers and are fixed on the transfer sheet.

The transfer sheet with the toner images fixed is then sent along the conveying path 53, is ejected sequentially to the receiving tray 58 via the guide gate 57, and is accumulated on the receiving tray 58.

Further, the transfer sheet is fed to the secondary transfer unit 51 from the sheet cassettes CS1 and CS2 or the manual sheet feed tray 81 via the aligning roller 55.

In the image forming portion 10, by the driving force from the drive motor 61, the intermediate transfer belt 13 of the intermediate transfer unit 14 and the photosensitive drum 12 can be driven synchronously. The reduction gear mechanism 64 composing the rotary member drive unit 60 is composed of a multi-stage reduction gear train of one system in the series state and moreover, the intermediate driven gears 66 and 73 for driving the intermediate transfer belt 13 and the drum drive gear 74 for driving the photosensitive drum 12 are directly meshed with each other, so that the behaviors of the intermediate transfer belt 13 and photosensitive drum 12 and uneven rotation can be synchronized always. Therefore, the color matching accuracy is improved and there are few jitters and color slips due to uneven rotation in the superimposed toner transfer images on the intermediate transfer belt 13.

Figure 7:
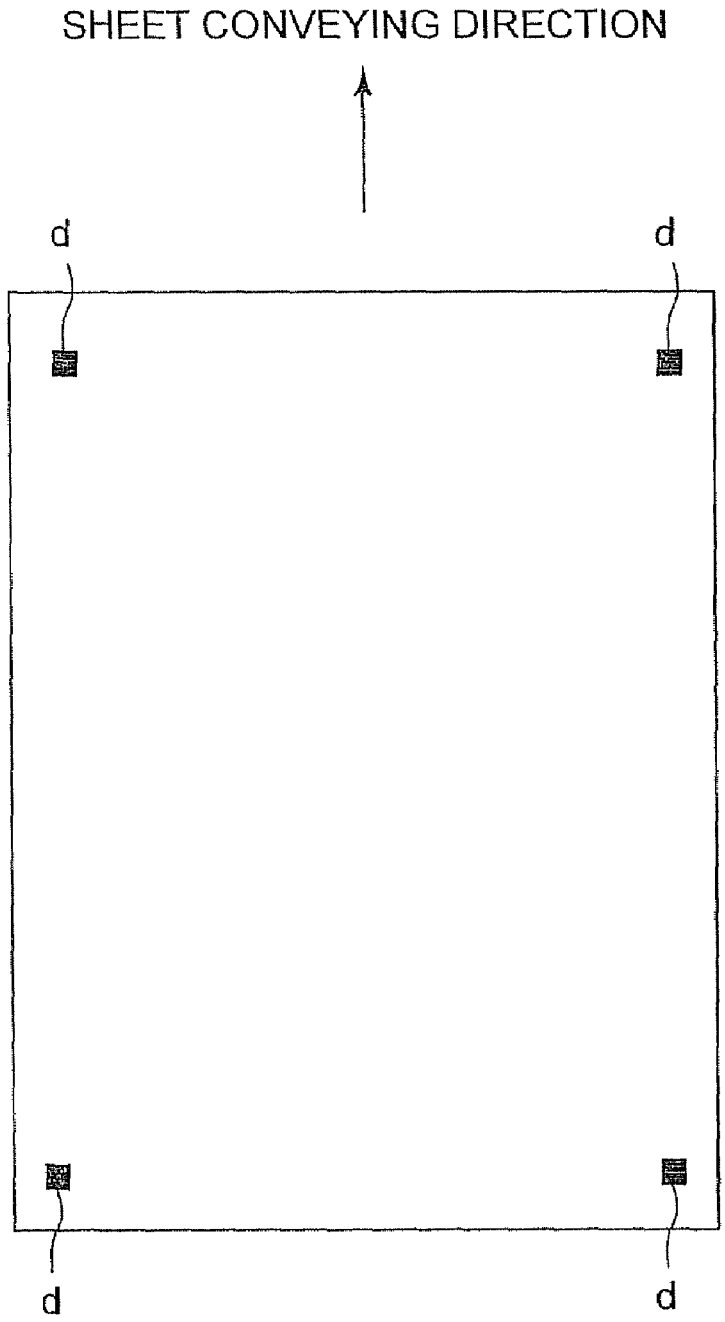
FIG. 7 is a plan view showing an example of the marking method on a sheet.
Figure 8:
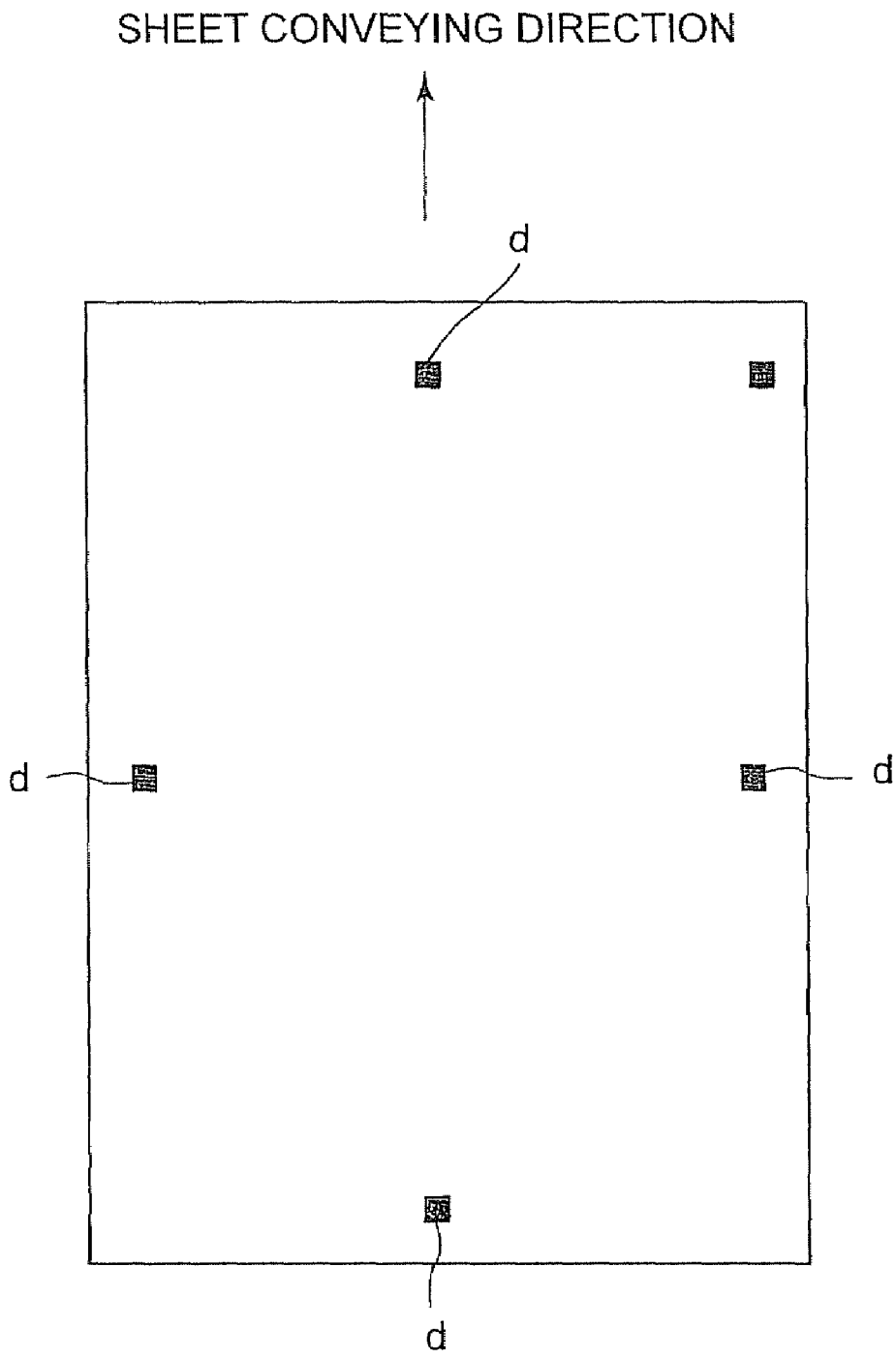
FIG. 8 is a plan view showing another example of the marking method on a sheet.
Figure 9:
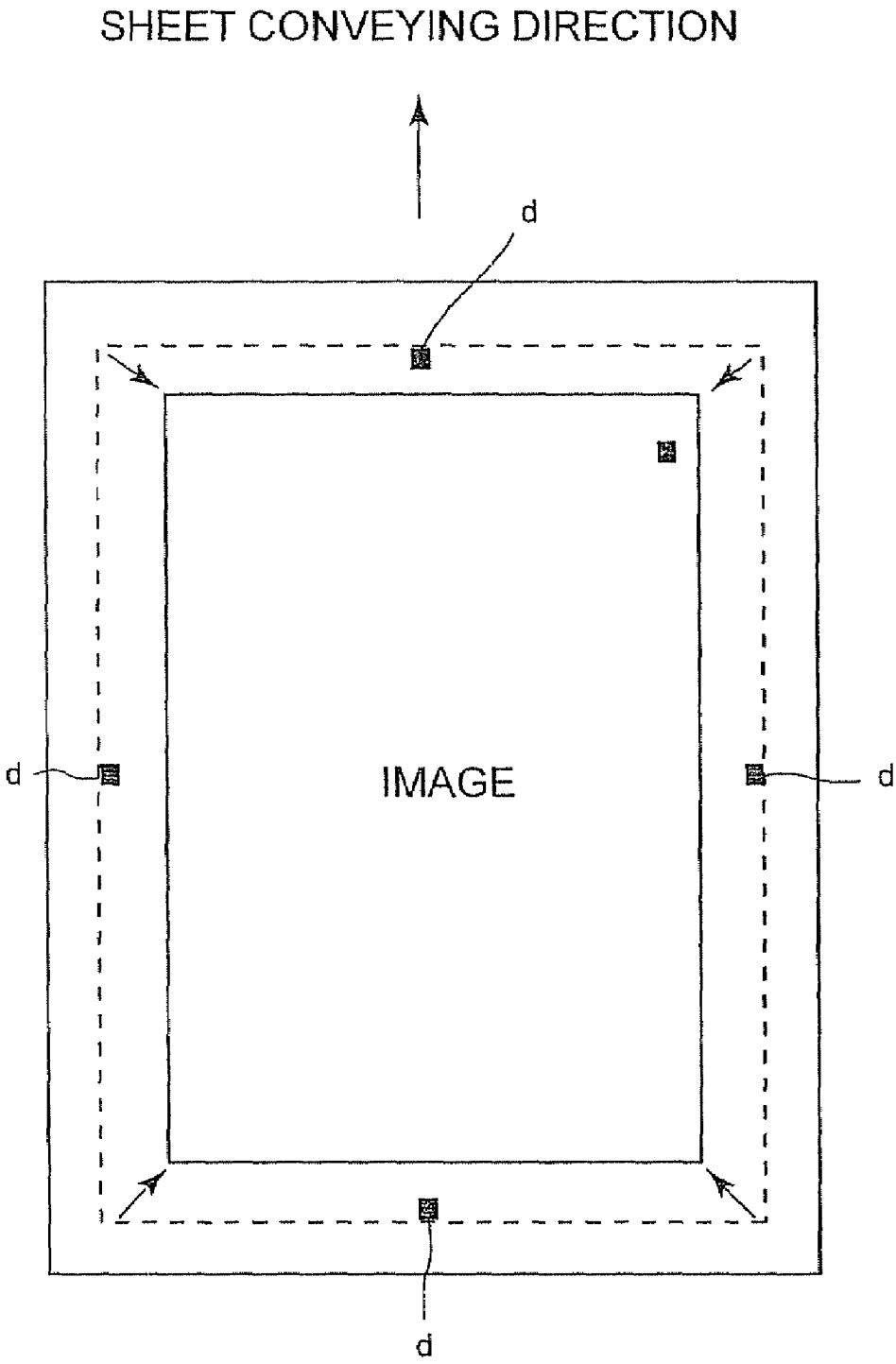
FIG. 9 is a plan view showing still another example of the marking method on a sheet.

Further, the image forming apparatus of this embodiment has a constitution that a sheet on which an image is formed by decolorizing toner is reused next for the image forming process by decolorizing toner. Therefore, at time of image formation by decolorizing toner, the image forming apparatus puts a mark on the sheet to indicate that an image is formed on the print side thereof by decolorizing toner. FIGS. 7 to 9 are drawings showing an example of the marking method when putting a mark on a sheet using decolorizing toner.

Concretely, the image forming portion (identification image forming unit) 10, when it is discriminated that the "decolorizing toner mode (second mode)" is selected by the mode discriminate unit 901, in the image forming process in which it is discriminated that the decolorizing toner mode is selected, on a sheet for forming an image by decolorizing toner, puts a mark indicating that the image forming process by decolorizing toner is performed.

FIG. 7 is a drawing showing an example of the marking executed by printing almost square solid images (predetermined identification images) in the four corners of the sheet. In the image forming apparatus of a system using the sheet ends as a standard for sheet conveyance and sheet positioning, according to the marking method shown in the drawing, the position of the mark printed at least on the end side as a standard of the sheet in the main scanning direction is fixed, so that the arrangement position of the sensor for detecting the mark can be identified at a predetermined position.

Further, FIG. 8 is a drawing showing an example of the marking executed by printing almost square solid images at the central positions in the sheet conveying direction (the so-called sub-scanning direction) and the central positions in the direction (the so-called main scanning direction) perpendicular to the sheet conveying direction. In the image forming apparatus of a system (the so-called center sheet feed system) using the central position of the sheet as a standard for sheet conveyance and sheet positioning, according to the marking method shown in the drawing, the position of the mark printed at least on the central position as a standard of the sheet in the main scanning direction is fixed, so that the arrangement position of the sensor for detecting the mark can be identified at a predetermined position.

Further, the marking methods shown in FIGS. 7 and 8, when printing on a sheet using decolorizing toner, use a constitution that the outside of the printing area of the sheet is marked.

Further, the marking method shown in FIG. 9 is a method for shortening and printing the image area to be printed by decolorizing toner to a size smaller than a predetermined area (indicated by a dashed line in FIG. 9) image-formable on a sheet by the image conditioning unit 902 and image forming portion 10 and marking the free area (outside the reduced image in the predetermined area) outside the print image obtained by the reduction process by the image forming portion 10. According to it, within the range of the limited print area, even when performing the print process such as printing an image in overall the print area, the aforementioned marking can be carried out without causing damage to the image to be printed.

In this embodiment, the example that the mark used for the marking indicating that an image is formed by decolorizing toner is almost a square is described, though the present invention is not limited to it and other figures and characters may be used. Further, even if each sheet is conveyed in any direction, to prevent reading of the mark from adversely affected (so as to be detected easily), it is effective to use a solid image in a square shape having sides parallel with the sheet conveying direction or a shape close to a circle.

Further, this embodiment has a constitution that the image forming portion 10 has a roll as an identification image forming unit, though the present invention is not limited to it and for example, it is possible to install separately an exclusive image forming portion for forming an identification image on a sheet and execute the aforementioned marking by the exclusive image forming portion.

Further, in this embodiment, for a sheet marked once, even if printing by decolorizing toner is selected, when it is judged by the detector that the sheet is printed by decolorizing toner, the marking is not necessary, so that from the viewpoint of the consumption amount of toner, the marking will not be carried out.

Figure 10:
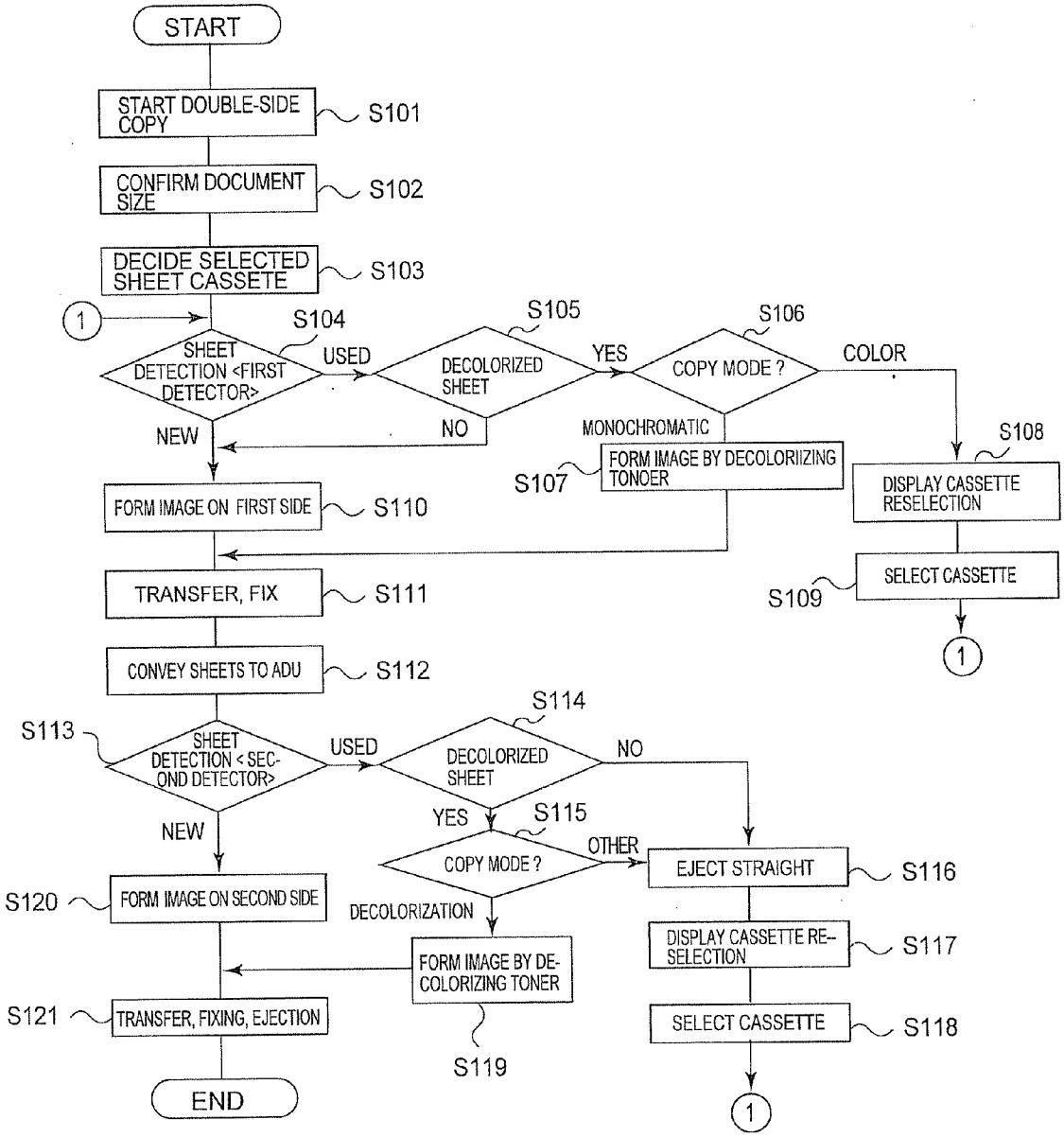
FIG. 10 a flow chart showing the flow of the process for reusing a sheet printed by decolorizing toner.

Using the image forming portion explained above, to reuse effectively a sheet printed by decolorizing toner (printing by decolorizing toner is enabled again), as indicated by the flow chart shown in FIG. 10, the following control is executed.

When double side copy is started (S101), the size of a document which is a subject of the copy is confirmed (S102). Then, on the basis of the confirmed document size, it is decided to feed a sheet from which the sheet cassettes (S103).

Then, the print condition on the first side of the sheet is detected by the detector 32 (the detection step) (S104) and when any image is formed on the first side (Used at S104), whether the image formed on the first side is printed by decolorizing toner or not is decided (S105). On a sheet printed by decolorizing toner and then decolorized by the decolorizing device, by visual observation, the image disappears, though actually, an almost colorless binder remains. When detecting the binder by a reflection-type sensor, it can be judged whether decolorizing toner is adhered or not. In this embodiment, only by seeing a sheet on which an image is formed by decolorizing toner and it is decolorized, it cannot be discriminated on which side the image is printed by decolorizing toner, so that both sides of the sheet are detected by the detector.

As a result of the aforementioned decision, when the first side is printed by decolorizing toner (Yes at S105), the mode discriminate unit 901 decides which is the mode of double side copy, the color mode or the monochromatic mode (S106). When it is the monochromatic mode (Monochromatic at S106), the image forming process by decolorizing toner is performed (S107).

On the other hand, when the double side copy mode is the color mode (Color at S106), the sheet re-feed unit 905 displays the purport of reselection of a cassette for feeding sheets on the screen (displays the control panel for promoting resetting of the sheet cassettes or resetting by the printer driver of a client personal computer), automatically reselects a cassette on the basis of a predetermined rule (S108 and S109), and returns to Step S104. Needless to say, the reselection of the concerned cassette can be carried out on the basis of operation input by a user.

When the print condition on the first side of the sheet is detected by the detector 32 (S104), if no image is formed on the first side (New at S104), the image forming process is performed on the first side (S110), and the toner image is heated and fixed on the sheet (S111), and then to form an image on the second side of the sheet, the sheet with the image formed on the first side thereof is conveyed to an ADU (auto duplex unit) 70 (S112).

Next, when the print condition on the second side of the sheet is detected by the detector 33, if any image is formed on the second side (Used at S104), the CPU 801 decides whether the image formed on the second side is printed by decolorizing toner or not (S114). Here, on at least either of the first side and second side of the sheet which is a subject of the image forming process to be executed, when a predetermined identification image for indicating that the image forming process by decolorizing toner is performed is formed, on the side where the concerned identification image is formed, it is decided that an image by decolorizing toner is formed.

Here, when an image by decolorizing toner is formed on the second side of the sheet (Yes at S114) and the copy processing mode discriminated by the mode discriminate unit 901 is the "decolorizing mode (second mode)" (Decolorization at S115), the CPU 801 starts the image forming process on the second side of the sheet by decolorizing toner (S119). As mentioned above, the process controlling unit 906, when a predetermined identification image is detected by the detector and it is discriminated by the mode discriminate unit 901 that the "decolorizing toner mode" is selected, starts the image forming process by decolorizing toner on the sheet side where the predetermined identification image is detected.

On the other hand, when no image by decolorizing toner is formed on the second side of the sheet (No at S114) or the copy processing mode is not the "decolorizing toner mode" (the first mode) (Others at S115), the sheet on the second side of which the image by decolorizing toner is formed is ejected straight (S116), and the process controlling process 906 displays the purport of reselection of a cassette for feeding sheets on the screen, automatically reselects a cassette on the basis of the predetermined rule (S117, S118), and returns to Step S104. Needless to say, the reselection of the concerned cassette can be carried out on the basis of operation input by a user. The sheet re-feed unit 905, when the predetermined identification image is detected by the detector and it is discriminated by the mode discriminate unit 901 that the "permanent color toner mode" is selected, permits to refeed sheets from the permanent color sheet cassette CS2. Further, here, the specific cassette CS2 means, for example, a cassette in which only new sheets are set beforehand. As mentioned above, the process controlling unit 906 prohibits the image forming process by permanent color toner for the sheet on which the predetermined identification image is detected (the process control step).

When no image is formed on the second side of the sheet (New at S113), the process controlling unit 906 performs the image forming process scheduled for the second side of the sheet, heats and fixes the toner image (S121), and completes the process.

Each step of the aforementioned process of the image forming apparatus is realized by executing the image forming program stored in the memory 802 by the CPU 801.

Figure 11:
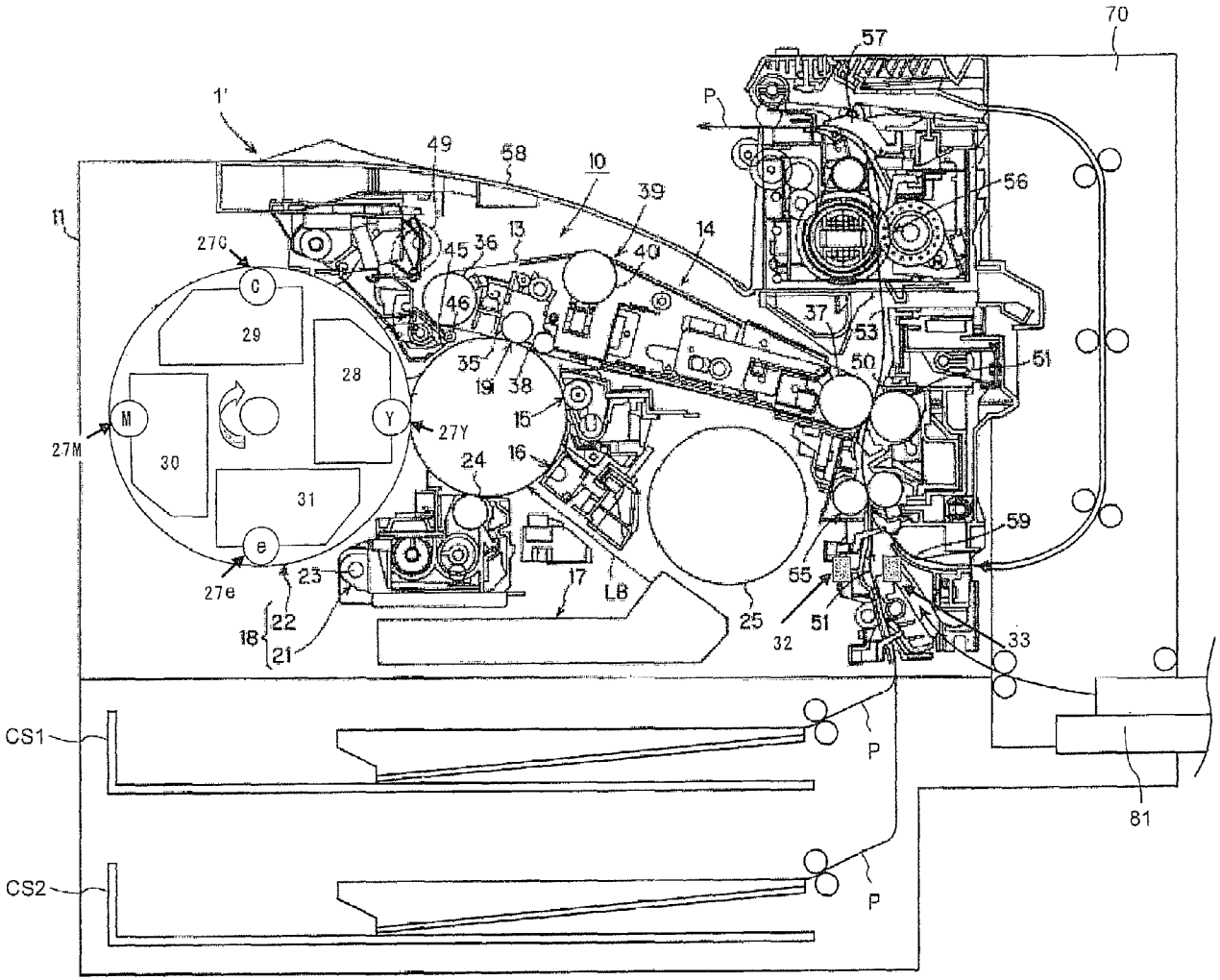
FIG. 11 is a schematic cross sectional view of the image forming apparatus including a sheet cassette having an arranged detection means.

Further, in the embodiment aforementioned, an example that the detector (detector unit) for detecting the print conditions on the first and second sides of the sheet is arranged in the neighborhood of the aligning roller 55 on the upstream side in the sheet conveying path is shown, though the present invention is not limited to it. For example, as in an image forming apparatus 1' shown in FIG. 11, a constitution may be used that a detector 103 and a detector 104 for detecting the print condition (whether the predetermined identification image is formed or not) of the first side of the sheet are arranged in the neighborhood of the sheet cassette (sheet feed unit) and a detector 101 (the first detector unit) for detecting the print condition of the second side of the sheet is arranged in the neighborhood of the manual sheet feed tray. In this case, the print condition of the first side of the sheet, when the sheet is positioned in the sheet cassette, is detected by the detector 103 (the first detector unit) or the detector 104 (the first detector unit) and the print condition of the second side, when the sheet is fed from the manual sheet feed tray 81, is detected by the detector 101.

Figure 12:
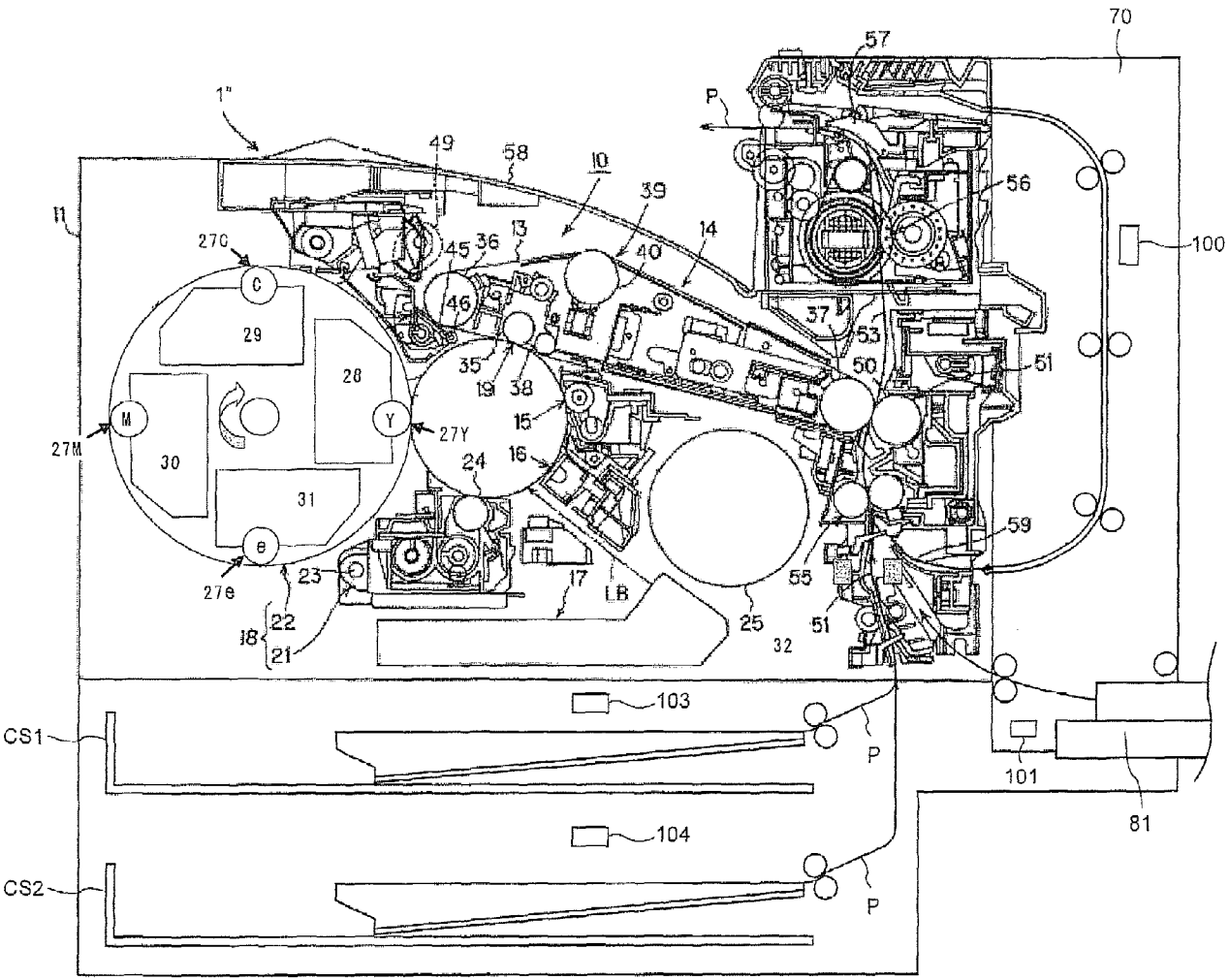
FIG. 12 is a schematic cross sectional view of the image forming apparatus including an ADU having an arranged detection means.

Further, the detector for detecting the print condition of the second side of the sheet is not always arranged in the neighborhood of the aligning roller 55 on the upstream side in the sheet conveying path and for example, as in a detector 100 (the second detector unit) in an image forming apparatus 1" shown in FIG. 12, it may be arranged in the sheet conveying path in the ADU 70. In such a constitution that the detector is arranged in the ADU, as compared with the case that the detector is arranged in the neighborhood of the aligning roller 55 on the upstream side in the sheet conveying path, there are advantages that the degree of freedom of the arrangement position of the detector is high and it can be easily adopted by a small image forming apparatus.

Further, in the embodiment aforementioned, an example that the detector is arranged in the neighborhood of the center of the sheet in the direction perpendicular to the sheet conveying direction is shown, though the present invention is not limited to it and for example, it may be arranged in the neighborhood of the sheet end in the direction perpendicular to the sheet conveying direction. It is desirable to set the arrangement position of the detector in the direction perpendicular to the sheet conveying direction, as mentioned above, according to the print position of the identification image to be formed by decolorizing toner on the sheet.

As mentioned above, according to this embodiment, image formation by color toner and decolorizing toner can be realized by one image forming apparatus, thus the cost and installation area can be reduced and user advantages can be obtained. Furthermore, with respect to reuse of sheets, sheets printed once by decolorizing toner are controlled so as not to be printed by toner other than decolorizing toner, thus the reuse efficiency of sheets can be increased.

This embodiment is explained by using the case that the function for executing the invention is recorded beforehand in the apparatus, though the present invention is not limited to it, and the similar function may be down-loaded in the apparatus from a network or a recording medium storing the similar function may be installed in the apparatus. With respect to the recording medium, if it can store programs such as a CD-ROM and can be read by the apparatus, the form thereof is no particular object. Further, the function obtained beforehand by installation or down-load like this may be realized in cooperation with the operating system (OS) in the apparatus.

The present invention is explained above in detail by referring to a specific aspect, though it is obvious for those who are skilled in the art in the field of the present invention that the present invention can be modified and improved without deviated from the spirit and scope of the present invention.

As mentioned above in detail, according to the present invention, in the image forming apparatus to form an image by permanent color toner and decolorizing toner, when reusing a sheet on which an image is formed using decolorizing toner, an art for preventing image formation by permanent color toner can be provided.

What is claimed is:

1. An image forming apparatus to form an image on a sheet by permanent color toner and decolorizing toner to be decolorized, comprising:

a detector unit to detect whether a predetermined identification image for indicating execution of an image forming process by decolorizing toner is formed or not at least on either of a first side and a second side of a sheet which is a subject of the image forming process to be executed; and a process controlling unit to prohibit the image forming process by the permanent color toner on the sheet side on which the predetermined identification image is detected when the identification image is detected by the detector unit.

2. The image forming apparatus according to claim 1 further comprising:

a mode discriminate unit, regarding the image forming process to be executed, to discriminate which is selected, a first mode to perform the image forming process by the permanent color toner or a second mode to perform the image forming process by the decolorizing toner, wherein the process controlling unit, when the predetermined identification image is detected by the detector unit and it is discriminated by the mode discriminate unit that the second mode is selected, starts the image forming process by the decolorizing toner on the sheet side where the predetermined identification image is detected.

3. The image forming apparatus according to claim 1 further comprising:

a mode discriminate unit, regarding the image forming process to be executed, to discriminate which is selected, a first mode to perform the image forming process by the permanent color toner or a second mode to perform the image forming process by the decolorizing toner; and a sheet re-feed unit, when the predetermined identification image is detected by the detector and it is discriminated by the mode discriminate unit that the first mode is selected, to permit a specific sheet feed unit to refeed sheets, wherein the process controlling unit starts the image forming process by the permanent color toner on the sheets refed by the sheet re-feed unit.

4. The image forming apparatus according to claim 1, wherein the detector unit is arranged in the neighborhood of an aligning roller on the upstream side in the sheet conveying direction.

5. The image forming apparatus according to claim 1, wherein the detector unit includes a first detection unit provided in the neighborhood of a sheet feed unit to detect whether the predetermined identification image is formed on the first side of the sheet or not and a second detection unit provided in the neighborhood of an aligning roller on the upstream side in the sheet conveying direction to detect whether the predetermined identification image is formed on the second side of the sheet or not.

6. The image forming apparatus according to claim 1, wherein the detector unit includes a first detection unit provided in the neighborhood of a sheet feed unit to detect whether the predetermined identification image is formed on the first side of the sheet or not and a second detection unit provided in an ADU unit to detect whether the predetermined identification image is formed on the second side of the sheet or not.

7. The image forming apparatus according to claim 1, wherein the detector unit is arranged in the neighborhood of the center of the sheet in the direction perpendicular to the sheet conveying direction.

8. The image forming apparatus according to claim 1, wherein the detector unit is arranged in the neighborhood of the sheet end in the direction perpendicular to the sheet conveying direction.

9. An image forming apparatus to form an image on a sheet by permanent color toner and decolorizing toner to be decolorized, comprising:

a mode discriminate unit, regarding an image forming process to be executed, to discriminate which is selected, a first mode to perform an image forming process by permanent color toner or a second mode to perform the image forming process by decolorizing toner; and an identification image forming unit, when it is discriminated by the mode discrimination unit that the second mode is selected, in the image forming process in which it is discriminated that the second mode is selected, to form a predetermined identification image to indicate execution of the image forming process by decolorizing toner on a sheet on which an image is to be formed by decolorizing toner.

10. The image forming apparatus according to claim 9, wherein the identification image forming unit forms the predetermined identification image by the decolorizing toner.

11. The image forming apparatus according to claim 9, wherein the identification image forming unit forms the predetermined identification image in the neighborhood of the center of the sheet in the direction perpendicular to the sheet conveying direction in the image forming apparatus.

12. The image forming apparatus according to claim 9, wherein the identification image forming unit forms the predetermined identification image in the neighborhood of the sheet end in the direction perpendicular to the sheet conveying direction in the image forming apparatus.

13. The image forming apparatus according to claim 9 further comprising:

an image conditioning unit to reduce an image to be formed on a sheet to a size smaller than a predetermined area to form an image and form the image on the sheet by the image forming apparatus, wherein the identification image forming unit forms the identification image outside and in the predetermined area of the image reduced by the image conditioning unit.

14. The image forming apparatus according to claim 9, wherein the predetermined identification image is a square having sides parallel with the sheet conveying direction.

15. The image forming apparatus according to claim 9, wherein the predetermined identification image is a circle.

16. An image forming apparatus to form an image on a sheet by permanent color toner and decolorizing toner to be decolorized, comprising:

a mode discriminate unit, regarding an image forming process to be executed, to discriminate which is selected, a first mode to perform an image forming process by permanent color toner or a second mode to perform the image forming process by decolorizing toner;

an identification image forming unit, when it is discriminated by the mode discrimination unit that the second mode is selected, in the image forming process in which it is discriminated that the second mode is selected, to form a predetermined identification image to indicate execution of the image forming process by decolorizing toner on a sheet on which an image is to be formed by decolorizing toner;

a detector unit to detect the predetermined identification image formed by the identification image forming unit; and a process controlling unit, when the identification image is detected by the detector unit, to prohibit the image forming process by the permanent color toner on the sheet side on which the predetermined identification image is detected.

17. An image forming process controlling method for an image forming apparatus to form an image on a sheet by permanent color toner and decolorizing toner to be decolorized, comprising:

detecting whether a predetermined identification image to indicate execution of an image forming process by decolorizing toner is formed or not at least on either of a first side and a second side of a sheet which is a subject of the image forming process to be executed; and prohibiting, when the predetermined identification image is detected, the image forming process by the permanent color toner on the sheet side on which the predetermined identification image is detected.

18. An image forming process controlling method for an image forming apparatus to form an image on a sheet by permanent color toner and decolorizing toner to be decolorized, comprising:

discriminating, regarding an image forming process to be executed, which is selected, a first mode to perform the image forming process by permanent color toner or a second mode to perform the image forming process by decolorizing toner; and forming, when it is discriminated that the second mode is selected, in the image forming process in which it is discriminated that the second mode is selected, a predetermined identification image to indicate execution of the image forming process by the decolorizing toner on a sheet on which an image is to be formed by the decolorizing toner.

19. An image forming process controlling method for an image forming apparatus to form an image on a sheet by permanent color toner and decolorizing toner to be decolorized, comprising:

discriminating, regarding an image forming process to be executed, which is selected, a first mode to perform the image forming process by permanent color toner or a second mode to perform the image forming process by decolorizing toner;

forming, when it is discriminated that the second mode is selected, in the image forming process in which it is discriminated that the second mode is selected, a predetermined identification image to indicate execution of the image forming process by the decolorizing toner on a sheet on which an image is to be formed by the decolorizing toner;

detecting the predetermined identification image formed; and prohibiting, when the identification image is detected, the image forming process by the permanent color toner on the sheet side on which the predetermined identification image is detected.

* * * * *